US006251149B1

(12) United States Patent
Meyer et al.

(10) Patent No.: US 6,251,149 B1
(45) Date of Patent: Jun. 26, 2001

(54) ABRASIVE GRINDING TOOLS WITH HYDRATED AND NONHALOGENATED INORGANIC GRINDING AIDS

(75) Inventors: Gerald W. Meyer, Framingham; Paul E. Johnson, Worcester, both of MA (US)

(73) Assignee: Norton Company, Worcester, MA (US)

( * ) Notice: Subject to any disclaimer, the term of this patent is extended or adjusted under 35 U.S.C. 154(b) by 0 days.

(21) Appl. No.: 09/075,294

(22) Filed: May 8, 1998

(51) Int. Cl.[7] ..... B24D 3/28; B24D 3/34

(52) U.S. Cl. ..... 51/298; 51/295; 51/307; 51/308; 51/309

(58) Field of Search ..... 51/298, 307, 295, 51/309, 308

(56) References Cited

U.S. PATENT DOCUMENTS

| | | | | |
|---|---|---|---|---|
| 3,806,956 | | 4/1974 | Supkis et al. | 51/281 R |
| 3,836,345 | * | 9/1974 | Graham | 51/298 |
| 3,963,458 | | 6/1976 | Gladstone et al. | 51/295 |
| 4,381,925 | * | 5/1983 | Colleselli | 51/298 |
| 4,657,563 | | 4/1987 | Licht et al. | 51/308 |
| 4,682,988 | | 7/1987 | Narayanan et al. | 51/298 |
| 4,869,839 | | 9/1989 | Griffin et al. | 252/56 R |
| 5,104,424 | | 4/1992 | Hickory et al. | 51/309 |
| 5,167,674 | | 12/1992 | Ika | 51/298 |
| 5,203,884 | | 4/1993 | Buchanan et al. | 51/295 |
| 5,221,295 | | 6/1993 | Zador | 51/298 |
| 5,304,225 | * | 4/1994 | Gardziella et al. | 51/298 |
| 5,429,648 | | 7/1995 | Wu | 51/296 |
| 5,507,850 | | 4/1996 | Helmin | 51/298 |
| 5,518,443 | | 5/1996 | Fisher | 451/540 |
| 5,534,593 | | 7/1996 | Friedman | 525/240 |
| 5,549,962 | * | 8/1996 | Holmes et al. | 51/298 |
| 5,551,961 | * | 9/1996 | Engen et al. | 51/298 |
| 5,573,846 | | 11/1996 | Harig et al. | 428/323 |
| 5,702,811 | | 12/1997 | Ho et al. | 428/323 |
| 5,912,216 | * | 6/1999 | Thimmappaiah et al. | 51/298 |

FOREIGN PATENT DOCUMENTS

| | | |
|---|---|---|
| 59-024963 | 2/1984 | (JP) . |
| 6-184523 | 7/1994 | (JP) . |

OTHER PUBLICATIONS

Markezich, R.L. et al., "Use Of A Chlorinated Flame Retardant In Combination With Other Flame Retardants," Flame Retardants, 203–211, 1994 (No Month).

Bothon, R.N., "Production Of Carbonates And Hydrates And Their Use As Flame Retardant Fillers," 108 Macromol. Symp. 221–229 (1996), No Month.

Hornsby, P.R., "The Application of Hydrated Mineral Fillers as Fire Retardant and Smoke Suppressing Additives for Polymers," 108 Macromol. Symp. 203–219 (1996), (No Month).

Smith, R., et al., "FR–1808, A Novel Flame Retardant for Environmentally Friendly Applications," AddCon 1995, comprising 4 pages, (No Month).

* cited by examiner

*Primary Examiner*—Michael Marcheschi
(74) *Attorney, Agent, or Firm*—Hamilton, Brook, Smith & Reynolds, P.C.

(57) ABSTRACT

A bonded-abrasive tool includes a matrix of an organic bond, abrasive grains dispersed in the organic bond and a grinding aid in the form of either an inorganic nonhalogenated filler or a hydrated filler. The inorganic nonhalogenated filler can react with free radicals released from the organic bond during grinding. The hydrated filler endothermically releases water. A coated-abrasive tool includes a flexible substrate, abrasive grains bonded to the flexible substrate, and an organic bond containing a grinding aid including an inorganic nonhalogenated filler or a hydrated filler coated on the substrate.

35 Claims, No Drawings

ABRASIVE GRINDING TOOLS WITH HYDRATED AND NONHALOGENATED INORGANIC GRINDING AIDS

BACKGROUND OF THE INVENTION

Tools employed for grinding often include abrasive grains bonded in or to a polymer. Typically, such tools are in the form of bonded composites, or flexible substrates coated with abrasive compositions. In both cases, however, wear of grinding tools is determined by several factors including, for example, the material being ground, the force applied to the grinding surface, the rate of wear of the abrasive grains, and the chemical and physical properties of the polymer employed to bond the abrasive grains.

Grinding efficiency in a bonded composite is affected by the rate at which the bonding polymer wears, decomposes, liquefies or is otherwise lost. For example, if the polymer bond is lost too rapidly, abrasive grains will be thrown off before they are worn sufficiently to have exhausted their capacity to effectively grind. Conversely, if the polymer bond does not wear away rapidly enough, abrasive grains will be retained on the surface of the grinding tool beyond their useful life, thereby preventing new underlying grains from emerging. Both effects generally can limit grinding efficiency.

Several approaches have been employed to improve the useful life of grinding tools and their efficiency. One such approach has been to employ a "grinding aid." Many types of grinding aids exist, and they are believed to operate by different mechanisms. According to one proposed mechanism, grinding temperature is decreased by reducing friction through use of a grinding aid that melts or liquefies during the grinding operation, thereby lubricating the grinding surface. In a second mechanism, the grinding aid reacts with the metal workpiece by corroding freshly cut metal chips, or swarf, thereby preventing reaction of the chips with the abrasive or rewelding of the chips to the base metal. In a third proposed mechanism, the grinding aid reacts with the ground metal surface to form a lubricant. A fourth proposed mechanism includes reaction of the grinding aid with the surface of the workpiece to promote stress-corrosion cracking, thereby facilitating stock removal.

SUMMARY OF THE INVENTION

The invention relates generally to abrasive tools.

In one embodiment, the abrasive tool of the invention is a bonded-abrasive tool including a matrix of an organic bond, abrasive grains dispersed in the organic bond, and an inorganic nonhalogenated filler that can react with free radicals formed from the organic bond during grinding.

In another embodiment, the abrasive tool of the invention is a bonded-abrasive tool including an organic bond, abrasive grains dispersed in the organic bond, and a hydrated filler in the organic bond.

In still another embodiment, the abrasive tool of the invention is a coated-abrasive tool including a flexible substrate, abrasive grains on the substrate, and an organic bond containing sodium antimonate or antimony oxide on the flexible substrate.

In yet another embodiment, the abrasive tool of the invention is a coated-abrasive tool including a flexible substrate, abrasive grains on the flexible substrate, and an organic bond containing a hydrated filler on the flexible substrate, wherein the hydrated filler is selected from the following: calcium hydroxide, magnesium hydroxide, hydrated sodium silicate, alkali metal hydrates, nesquehonite, basic magnesium carbonate, magnesium carbonate subhydrate and zinc borate.

The present invention has many advantages. For example, an embodiment of an abrasive tool of the present invention that includes a hydrated filler as a grinding aid significantly reduces high temperatures produced by friction. It is believed that the hydrated filler limits temperature rise during grinding by endothermically releasing water, thereby slowing loss of the bond. In an abrasive tool of the invention that includes an inorganic nonhalogenated filler, the inorganic nonhalogenated filler reduces degradation of the bond by reacting with free radicals released from the bond during grinding. The fillers incorporated in the abrasive tools of this invention may reduce the likelihood of thermal degradation in the manner of flame retardants. All of these mechanisms can significantly increase the useful life and efficiency of bonded and coated abrasive tools. Further, the grinding aids included in the abrasive tools of this invention, unlike many grinding aids, will not release potentially-hazardous halogens during grinding.

DESCRIPTION OF PREFERRED EMBODIMENTS

The features and other details of the method of the invention will now be more particularly described. It will be understood that the particular embodiments of the invention are shown by way of illustration and not as limitations of the invention. The principle features of this invention can be employed in various embodiments without departing from the scope of the invention.

An abrasive tool of this invention includes an organic bond, abrasive grains and a grinding aid that includes a hydrated filler and/or an inorganic nonhalogenated filler, wherein the grinding aid advantageously alters the thermal and/or mechanical degradation of the organic bond during grinding. In one preferred example, the abrasive tool is a resin-bonded grinding wheel.

The organic bond of the abrasive tool is suitable for use as a matrix material of a grinding wheel, with abrasive grains dispersed throughout. An example of a suitable organic bond is a thermosetting resin. Preferably, the thermosetting resin is either an epoxy resin or a phenolic resin. Specific examples of suitable thermosetting resins include phenolic resins (e.g., novolak and resole), epoxy, unsaturated polyester, bismaleimide, polyimide, cyanate ester, etc.

Typically, the volume of the organic bond is between about 2% and about 64% of the abrasive grinding composition of a bonded-abrasive tool, wherein the abrasive grinding composition is defined as the bond, abrasive grains, fillers in the bond, and porosity in the bond. Preferably, the volume of organic bond in an abrasive grinding composition of a bonded-abrasive tool of this invention is in a range of between about 20% and about 60%, and more preferably about 30–42%.

In a typical coated-abrasive tool suitable for use with the present invention, the abrasive grinding composition is coated on a flexible substrate of, for example, paper, film, or woven or stitched bonded cloth. A resinous bond, also known as a maker coat, is coated on the flexible substrate. Abrasive grains are then applied to the maker coat by electrostatic techniques or by a simple gravity feed and are secured to the maker coat with a phenolic size coat. Optionally, a supersize coat can be applied over the size coat. Grinding aids are typically included in the size or the supersize coat. Each of the coatings may be applied in a polymeric carrier of, for example, acrylic polymer. After each application, the tool is cured, typically at about 107° C. Further descriptions of coated abrasive tools suitable for application of the present invention is provided in U.S. Pat. Nos. 5,185,012, 5,163,976, 5,578,343 and 5,221,295, the teachings of all of which are incorporated herein by reference in their entirety. In a preferred embodiment, the bond, or maker coat, of a suitable coated-abrasive tool is EBECRYL™ 3605 resin (a reaction product of diepoxylated bisphenol A and acrylic acid in a one-to-one molar relationship, available from UCB Chemicals). It has a mass, expressed as a function of substrate surface area, of 30 $g/m^2$ in a preferred embodiment.

Abrasive grains of the abrasive tool generally are suitable for grinding metal, or in some instances, ceramic workpieces. Examples of suitable abrasive grains are those formed of aluminum oxide, diamond, cubic boron nitride, silicon carbide, etc. Generally, the size of abrasive grains in the abrasive tool of the invention is in a range between about 4 grit and about 240 grit (6,848–63 micrometers), preferably 4 to 80 grit (6,848–266 micrometers). Aluminum oxide grains with a grit size in a range between about 16 and about 20 grit (1,660–1,340 micrometers) are particularly suitable. The volume of abrasive grains in the abrasive grinding composition of a bonded-abrasive tool typically is in a range between about 34% and about 56% of the abrasive grinding composition. Preferably, in a bonded wheel, the volume of abrasive grains is in a range between about 40% and about 52%. In one embodiment of a coated-abrasive tool, the abrasive grains are 180-grit silicon carbide, and the mass of abrasive grains, expressed as a function of substrate surface area, is 188 $g/m^2$.

The abrasive grinding composition of a bonded-abrasive tool typically is porous. The porosity, or void fraction, of the abrasive grinding composition typically is in a range of up to about 52% of the volume of the abrasive grinding composition. Preferably, the void fraction is up to about 26% of the total volume of the abrasive grinding composition.

The grinding aid of an abrasive tool of this invention includes a hydrated filler and/or an inorganic nonhalogenated filler. Suitable hydrated fillers are those that dehydrate to release water during abrasive grinding of a metal workpiece. Examples of suitable hydrated fillers include zinc borate, available under the trademark FIREBRAKE™ ZB ($2ZnO.3B_2O_3.3.5H_2O$: dehydrates at 293° C.) or under the trademark FIREBRAKE™ 415 ($4ZnO.B_2O_3.H_2O$: dehydrates at 415° C.) from U.S. Borax; aluminum trihydrate ($Al(OH)_3$, available under the trademark HYDRAL™ 710 or PGA-SD™ from Alcoa); calcium hydroxide ($Ca(OH)_2$); magnesium hydroxide ($Mg(OH)_2$), available as FR-20 MHRM™ 23-2 (amino silane treated), FR-20 MHRM™ 640 (with polyolefin coupling agent) or FR-20 MHRM™ 120 (fatty surface treated) from Ameribrom, Inc.; hydrated sodium silicate ($Na_2SiO_3.9H_2O$); alkali metal hydrates; nesquehonite ($MgCO_3.Mg(OH)_2.3H_2O$); magnesium carbonate subhydrate ($MgO.CO_2(0.96)H_2O(0.30)$); etc.

Specific hydrated fillers provide particularly preferred advantages. An especially preferred hydrated filler is zinc borate. Zinc borate vitrifies at 500–600° C. and is believed to form a borate-type glass seal over the organic bond, thereby preventing thermal degradation of the organic bond. Another hydrated filler, aluminum trihydrate, is believed to form aluminum oxide ($Al_2O_3$) upon heating and dehydration. Aluminum oxide is a known abrasive material which can aid in the grinding process. Preferred hydrated fillers include aluminum trihydrate and magnesium hydroxide.

Another embodiment of the abrasive tool includes an inorganic nonhalogenated filler that reduces degradation of the organic bond during grinding. The phrase, "reduces degradation," as used herein, means that the inorganic nonhalogenated filler acts to preserve the organic bond by a mechanism other than merely increasing the ease with which stock is removed from the workpiece being ground, such as is believed to occur by, for example, use of iron disulfide ($FeS_2$) as a grinding aid, whereby the iron disulfide promotes stock removal by oxidizing the surface of the workpiece as well as chips therefrom. Examples of suitable inorganic nonhalogenated fillers include molybdenum (VI) oxide ($MoO_3$, available from Aldrich), sodium antimonate ($NaSbO_3$, available under the trademark THERMOGUARD™ FR from Elf Atochem), antimony oxide ($Sb_2O_3$, available under the trademark THERMOGUARD™ S from Elf Atochem), etc. In a preferred embodiment, the inorganic nonhalogenated filler is antimony oxide.

In still another embodiment, the grinding aid includes both hydrated and inorganic nonhalogenated fillers. Whether the grinding aid is a hydrated filler or an inorganic nonhalogenated filler, the grinding aid in a bonded-abrasive tool forms between about 10% and about 50% of the combined composition of bond and fillers, by volume, wherein "fillers" include active fillers, pore inducers, lime for water absorption, etc., but not abrasive grains. Preferably, the grinding aid of a bonded-abrasive tool forms between about 20% and about 40% of the combined composition of bond and fillers, by volume. Most preferably, the grinding aid of a bonded-abrasive tool forms about 25% of the combined composition of bond and fillers, by volume, though the ratio will vary depending on the grade and structure of the tool. Optionally, the abrasive tool further includes other fillers such as additional grinding aids (e.g., iron disulfide for reacting with the workpiece) and processing aids (e.g., wetting agents).

The above-listed components can be combined in any order to form an abrasive tool of this invention. In a preferred embodiment of a bonded-abrasive tool, the abrasive grains are wetted with a liquid resin (e.g., resole). Grinding aids (hydrated or inorganic nonhalogenated fillers), other fillers, a solid resin precursor to the organic bond (e.g., novolak), and a suitable catalyst (e.g., hexamethylenetriamine) for curing the resins are combined to form a mixture. The wetted abrasive grains are blended with the mixture to form a precursor composition. The precursor composition is then pressed in a mold and cured. Preferably, the composition is cured at a temperature in a range of between about 130° C. and about 230° C. The abrasive grinding composition is then in the form of an abrasive grinding or cutting tool, such as a bonded-abrasive wheel. Alternatively, the abrasive grinding composition is a component of an abrasive grinding or cutting tool. Other methods can also be employed to form abrasive grinding or cutting tools of the invention.

In an embodiment of a coated-abrasive tool of this invention, an abrasive grinding composition includes a maker coat, abrasive grains, a size coat, and, optionally, a supersize coat over the size coat. Grinding aids are typically included in the supersize coat, where present, or in the size coat. In this embodiment, the abrasive grinding composition is coated on a flexible substrate, such as a sheet, belt, disc, etc. Where a supersize layer, including a binder and a grinding aid, is present, the grinding aid preferably forms greater than about 50% of the combined solids weight of the binder and grinding aid. In another preferred embodiment, the grinding aid forms about 60 to 80% of the combined solids weight of the binder and grinding aid.

Bonded-abrasive wheels of the invention can be employed in a variety of applications. Examples of such applications include track grinding, wherein railroad tracks are ground to remove roundness, and foundry grinding, wherein metal articles cast in a foundry are ground to remove burrs and other casting defects. Other applications for bonded-abrasive wheels of the invention include, but are not limited to, "cutting-off" operations and steel conditioning. Coated-abrasive tools of the invention can be employed, for example, in many industrial applications, such as metal finishing.

When a bonded-abrasive wheel is used to grind a workpiece, such as a track or foundry article, abrasive grains at the surface of the organic bond grind the workpiece by cutting, plowing or rubbing the surface of the workpiece. The friction produced by these grinding mechanisms generates considerable heat, which can increase the rate at which the organic bond decomposes, melts or wears. As a result, the grinding surface of the organic bond retreats, and abrasive grains embedded within the matrix of organic bond are increasingly exposed until they eventually are stripped away from the abrasive tool. Fresh abrasive grains are gradually exposed with the retreat of the surface of the organic bond to provide sharp new surfaces for grinding.

Retreat of the surface of the organic bond also releases other components, such as the hydrated and/or inorganic nonhalogenated fillers employed in an abrasive tool of the invention. Hydrated fillers in the abrasive tool release water during grinding. It is believed that endothermic dehydration of the hydrated filler has a cooling effect at the grinding surfaces. It is also believed that water released by dehydration can act as a lubricant at the interface of the abrasive tool and the workpiece, and can absorb additional heat from the grinding surfaces by evaporation.

Inorganic nonhalogenated fillers in an abrasive tool are believed to reduce the rate at which the organic bond is lost from the grinding surface. One mechanism by which inorganic nonhalogenated fillers, as employed in the invention, are believed to reduce degradation is by inhibiting the chemical path by which an organic bond typically degrades. This chemical path generally includes oxidation of a polymer chain of the organic bond during grinding, which triggers the release of free radicals from the polymer chain. These free radicals then react with the organic bond at other points along the chain, causing the polymer to further degrade and release additional free radicals. The inorganic nonhalogenated fillers are believed to reduce degradation of the organic bond by inhibiting polymer chain-breaking caused by free radicals. It is believed that the inorganic nonhalogenated filler, or degradation products of the inorganic nonhalogenated filler, reduce degradation of the organic bond by combining, such as by reacting, with free radicals released from the organic bond. Once combined with the inorganic nonhalogenated filler or its degradation product, the radicals are not available to contribute to degradation of the organic bond.

The invention now will be further and more fully described by the following examples.

EXEMPLIFICATION

Example 1

A number of bonded-abrasive tools of the invention, in the form of portable wheels for use in a portable grinder, were fabricated to include one of several different hydrated fillers or inorganic nonhalogenated fillers. Further, a "standard" wheel (designated, "1," below) was fabricated to serve as a control for reference in evaluating grinding performance of wheels of this invention. In each of the wheels of this invention (designated, 2–7, below), the fillers were dispersed throughout the organic bond, forming about 25% of the combined bond/filler composition, by volume. The wheels that were fabricated with these compositions were used to grind a ring of 1026 carbon steel tubing having a 30.5-cm (12-inch) outer diameter, a 25.4-cm (10-inch) inner diameter and a length of 15.2 cm (6 inches). Grinding was performed using 6.8 kg (15 lbf), 9.1 kg (20 lbf) and 11.3 kg (25 lbf) of loading.

Each of the wheels had the following composition, with all percentages calculated by volume and with "variable active filler" being varied for each wheel:

| Material | Source | Volume % | Density (g/cc) |
|---|---|---|---|
| 29344 epoxy modified novalac resin | Oxychem Durez Dallas, TX | 21.33 | 1.28 |
| liquid resin (V136) | Bendix Resin Corporation Friction Materials Division Troy, NY | 5.67 | 1.28 |
| tridecyl alcohol | Exxon Chemical Company Houston, Texas | 20 cc/lb dry resin | 0.84 |
| iron disulfide - $FeS_2$ - 325 mesh | | 4.5 | 4.75 |
| brown alundum abrasive | Norton Company | 50 | 3.95 |
| porosity | | 14 | 0 |
| variable active filler | | 4.5 | |

The "variable active filler" in each of the wheels, listed by number, below, was of the following, respective composition:

1: potassium sulfate ($K_2SO_4$, from Astro Chemicals, Inc., Springfield, Mass.) (density=2.66 g/cc)

2: aluminum trihydrate ($Al(OH)_3$, HYDRAL 710 from Alcoa, Pittsburgh, Pa.) (density=2.4 g/cc)

3: calcium hydroxide ($Ca(OH)_2$, from Aldrich, Milwaukee, Wis.) (density=2.24 g/cc)

4: molybdenum (VI) Oxide ($MoO_3$, from Aldrich, Milwaukee, Wis.) (density=4.69 g/cc)

5: magnesium hydroxide ($Mg(OH)_2$, FR-20 MHRM 640 from Ameribrom, Inc., New York, N.Y.) (density=2.36 g/cc)

6: zinc borate ($4ZnO.B_2O_3.H_2O$, FIREBRAKE 415 from U.S. Borax, Valencia, Calif.) (density=3.70 g/cc)

7: antimony oxide ($Sb_2O_3$, THERMOGUARD S from Elf Atochem, Philadelphia, Pa.) (density=5.67 g/cc) w/DECHLORANE PLUS (the Diels-Alder diadduct of hexachlorocyclopentadiene and 1,5-cyclooctadiene, available from Occidental Chemical Corp., Niagara Falls, N.Y.) (density=1.9 g/cc) (1:3 by volume)

All wheels were tested for 18 minutes. The wheel-performance results are shown in the following three tables. As indicated in the tables, MRR represents the rate at which metal is removed from the workpiece. WWR represents wheel-wear rate. The g-ratio is the ratio of the volume of metal removed from the workpiece over the volume of the wheel that is worn away. Accordingly, a high g-ratio signifies a high degree of wheel durability relative to the amount of grinding that is performed and is generally desired.

TABLE 1

(6.8 kg)

| Wheel # | Actual Density (g/cc) | MRR (kg/hr) | WWR (cc/hr) | Power (kW) | 1/WWR (hr/cc) | Power/MRR | G-Ratio |
|---|---|---|---|---|---|---|---|
| 1 | 2.630 | 1.07 | 15.73 | 0.9016 | 0.06357 | 0.843 | 8.72 |
| 2 | 2.626 | 1.25 | 10.23 | 0.8568 | 0.09775 | 0.685 | 15.67 |
| 3 | 2.603 | 0.95 | 8.94 | 0.8292 | 0.1119 | 0.873 | 13.62 |
| 4 | 2.737 | 1.04 | 8.60 | 0.8680 | 0.1163 | 0.835 | 15.50 |
| 5 | 2.624 | 0.95 | 9.88 | 0.8471 | 0.1012 | 0.892 | 12.33 |
| 6 | 2.680 | 0.85 | 5.46 | 1.519 | 0.1832 | 1.787 | 19.96 |
| 7 | 2.631 | 1.24 | 12.00 | 0.8956 | 0.0833 | 0.722 | 13.25 |

TABLE 2

(9.1 kg)

| Wheel # | Actual Density (g/cc) | MRR (kg/hr) | WWR (cc/hr) | Power (kW) | 1/WWR (hr/cc) | Power/MRR | G-Ratio |
|---|---|---|---|---|---|---|---|
| 1 | 2.639 | 2.24 | 43.34 | 1.208 | 0.02069 | 0.539 | 5.94 |
| 2 | 2.627 | 2.93 | 24.80 | 1.137 | 0.04032 | 0.388 | 15.15 |
| 3 | 2.608 | 1.91 | 31.33 | 1.154 | 0.03192 | 0.604 | 7.82 |
| 4 | 2.732 | 1.81 | 24.08 | 1.129 | 0.04153 | 0.624 | 9.64 |
| 5 | 2.628 | 1.60 | 17.20 | 1.086 | 0.05814 | o.679 | 11.93 |
| 6 | 2.684 | 1.54 | 16.22 | 1.066 | 0.06165 | 0.692 | 12.17 |
| 7 | 2.622 | 2.16 | 28.81 | I.208 | 0.03471 | 0.559 | 9.61 |

TABLE 3

(11.3 kg)

| Wheel # | Actual Density (g/cc) | MRR (kg/hr) | WWR (cc/hr) | Power (kW) | 1/WWR (hr/cc) | Power/MRR | G-Ratio |
|---|---|---|---|---|---|---|---|
| 1 | 2.630 | 4.94 | 431.4 | 1.72 | 0.002318 | 0.348 | 1.47 |
| 2 | 2.626 | 4.08 | 153.1 | 1.72 | 0.006532 | 0.422 | 3.42 |
| 3 | 2.603 | 3.58 | 128.3 | 1.65 | 0.007794 | 0.461 | 3.58 |
| 4 | 2.737 | 4.35 | 216.6 | 1.70 | 0.004617 | 0.391 | 2.57 |
| 5 | 2.624 | 3.86 | 138.7 | 1.69 | 0.007210 | 0.438 | 3.57 |
| 6 | 2.680 | 3.24 | 104.1 | 1.54 | 0.009606 | 0.475 | 3.99 |
| 7 | 2.631 | 5.10 | 232.6 | 1.83 | 0.004300 | 0.359 | 2.81 |

As can be seen, each of the hydrated and inorganic nonhalogenated fillers performed with a higher g-ratio than the standard, control wheel (1) at each of the three load levels. Wheel 6, which had zinc borate as an active filler, performed with the greatest grinding efficiency, as measured by the g-ratio, in each test.

Example 2

In this example, testing was performed in the context of track grinding, which is a more aggressive operation than the fixed-head portable grinder that was used in Example 1. In track grinding, wheel life is a key factor in evaluating wheel performance. Again, wheels of this invention, including inorganic nonhalogenated fillers as well as hydrated fillers, were selected for testing.

Each of the wheels in this experiment had the following basic composition, with all percentages calculated by vol ume and with "variable active filler" being varied for each wheel:

| Material | Source | Volume % | Density (g/cc) |
|---|---|---|---|
| 29318 14% hexa novalac resin | Oxychem Durez Dallas, TX | 22.4 | 1.28 |
| tridecyl alcohol | Exxon Chemical Company Houston, Texas | 35 cc/lb dry resin | 0.84 |
| furfural | QO Chemicals, Inc. W. Lafayette, IN | 45 cc/lb dry resin | 1.16 |
| furfural/chlorinated parafin blend 60:40 vol.) | CHLOROFLO 40 blend from Dover Chemical Corporation Dover, OH | 4.5 cc/lb of mix | 1.13 |
| iron disulfide - $FeS_2$ - 325 mesh | | 4.0 | 4.75 |
| lime (CaO) pulverized quicklime (699159 K) | Mississippi Lime Company | 1.6 | 3.25 |
| brown alundum abrasive | Norton Company | 27.0 | 3.95 |
| NORZON abrasive | Norton Company | 27.0 | 4.66 |
| porosity | | 14 | 0 |
| variable active filler | | 4.0 | |

The "variable active filler" in each of the wheels, listed by number, below, was of the following, respective composition:

014-1: potassium sulfate ($K_2SO_4$, from Astro Chemicals, Inc., Springfield, Mass.) (density=2.66 g/cc)

014-2: aluminum trihydrate ($Al(OH)_3$, HYDRAL 710 from Alcoa, Pittsburgh, Pa.) (density=2.4 g/cc)

014-3: magnesium hydroxide ($Mg(OH)_2$, FR-20 MHRM 640 from Ameribrom, Inc., New York, N.Y.) (density=2.36 g/cc)

014-4: calcium hydroxide ($Ca(OH)_2$, from Aldrich, Milwaukee, Wis.) (density=2.24 g/cc)

014-5: zinc borate ($4ZnO.B_2O_3.H_2O$, FIREBRAKE 415 from U.S. Borax, Valencia, Calif.) (density=3.70 g/cc)

Again, the wheel with potassium sulfate as the variable active filler (wheel 014-1) was used as a control during testing.

As the grinding data, presented in Tables 4–6, show, the selected grinding aids enhanced the life of the wheels by as much as approximately 200% of the life of the control wheel. The specification with $Al(OH)_3$ did not show a life enhancement, probably due to its relatively low dehydration temperature (approximately 200° C.).

The results of Example 2 are provided in the following Tables, 4–6. Table 4 lists the results of tests performed at a 23.1 kW power level and a 5 minute grind time. Table 5 lists the results of tests performed at a 17.2 kW power level and a 6 minute grind time. Table 6 lists the results of tests performed at a 13.4 kW power level and a 15 minute grind time. Each of the values, listed below, represents an average of results from two tests, performed on different wheels, of each specification.

TABLE 4

| Wheel Spec. | Average Unit Power ($kW/mm^2$) | MRR ($mm^3/s$) | G-Ratio | Wheel Life (hrs.) |
|---|---|---|---|---|
| 014-1 | 0.0398 | 1543 | 3.9 | 0.7 |
| 014-2 | 0.0400 | 1557 | 4.6 | 0.8 |
| 014-3 | 0.0404 | 1509 | 4.7 | 0.8 |
| 014-4 | 0.0407 | 1515 | 6.3 | 1.1 |
| 014-5 | 0.0408 | 1542 | 8.2 | 1.4 |

TABLE 5

| Wheel Spec. | Average Unit Power ($kW/mm^2$) | MRR ($mm^3/s$) | G-Ratio | Wheel Life (hrs.) |
|---|---|---|---|---|
| 014-1 | 0.0301 | 759 | 15.7 | 5.3 |
| 014-2 | 0.0297 | 781 | 13.3 | 4.4 |
| 014-3 | 0.0300 | 782 | 17.5 | 5.7 |
| 014-4 | 0.0299 | 762 | 16.3 | 5.5 |
| 014-5 | 0.0308 | 672 | 21.5 | 8.2 |

TABLE 6

| Wheel Spec. | Average Unit Power ($kW/mm^2$) | MRR ($mm^3/s$) | G-Ratio | Wheel Life (hrs.) |
|---|---|---|---|---|
| 014-1 | 0.0234 | 428 | 23.5 | 14.6 |
| 014-2 | 0.0236 | 396 | 25.1 | 16.4 |
| 014-3 | 0.0236 | 395 | 27.6 | 18.3 |
| 014-4 | 0.0243 | 343 | 25.4 | 19.0 |
| 014-5 | 0.0246 | 332 | 27.0 | 20.9 |

EQUIVALENTS

While this invention has been particularly shown and described with references to preferred embodiments thereof, it will be understood by those skilled in the art that various changes in form and details may be made therein without departing from the scope of the invention as defined by the appended claims.

We claim:

1. A bonded-abrasive tool, comprising:

a) a matrix of an organic bond;

b) abrasive grains dispersed in the organic bond; and c) filler including molybdenum (VI) oxide in the organic bond.

2. The bonded-abrasive tool of claim 1, wherein the abrasive grains include a ceramic abrasive component.

3. The bonded-abrasive tool of claim 1, wherein the organic bond includes a polymeric material.

4. The bonded-abrasive tool of claim 1, wherein the organic bond includes a thermosetting resin.

5. The bonded-abrasive tool of claim 4, wherein the organic bond includes an epoxy resin.

6. The bonded-abrasive tool of claim 4, wherein the organic bond includes a phenolic resin.

7. The bonded-abrasive tool of claim 1, wherein the concentration of the molybdenum (VI) oxide is between about 10% and about 50%, by volume, of the organic bond and the filler.

8. The bonded-abrasive tool of claim 7, wherein the concentration of the molybdenum (VI) oxide is between about 20% and about 40%, by volume, of the organic bond and the filler.

9. The bonded-abrasive tool of claim 1, wherein the concentration of the organic bond is in a range between about 20% and about 60%, by volume, of an abrasive grinding composition that includes the organic bond, the abrasive grains, the filler, and porosity.

10. The bonded-abrasive tool of claim 9, wherein the concentration of the organic bond is in a range between about 30% and about 42%, by volume, of the abrasive grinding composition.

11. The bonded-abrasive tool of claim 1, wherein the abrasive grains have a size between about 4 grit and about 240 grit.

12. The bonded-abrasive tool of claim 11, wherein the abrasive grains have a size between about 4 grit and about 80 grit.

13. The bonded-abrasive tool of claim 1, wherein the concentration of the abrasive grains is in a range between about 34% and about 56%, by volume, of an abrasive grinding composition that includes the organic bond, the abrasive grains, the filler, and porosity.

14. The bonded-abrasive tool of claim 13, wherein the concentration of the abrasive grains is in a range between about 40% and about 52%, by volume, of the abrasive grinding composition.

15. A bonded-abrasive tool, comprising:

a) a matrix of an organic bond;

b) abrasive grains dispersed in the organic bond; and c) a hydrated filler in the organic bond, wherein the hydrated filler is selected from the group consisting of aluminum trihydrate, magnesium hydroxide, hydrated sodium silicate, alkali metal hydrates, nesquehonite, hydrated basic magnesium carbonate, magnesium carbonate subhydrate and hydrated zinc borate, wherein the concentration of the hydrated filler is between about 10% and about 50%, by volume, of the organic bond and filler.

16. The bonded-abrasive tool of claim 15, wherein the hydrated filler is hydrated zinc borate.

17. The bonded-abrasive tool of claim 15, wherein the hydrated filler is aluminum trihydrate.

18. The bonded-abrasive tool of claim 15, wherein the hydrated filler is magnesium hydroxide.

19. The bonded-abrasive tool of claim 15, wherein the abrasive grains include a ceramic abrasive component.

20. The bonded-abrasive tool of claim 15, wherein the organic bond includes a polymeric material.

21. The bonded-abrasive tool of claim 15, wherein the organic bond includes a thermosetting resin.

22. The bonded-abrasive tool of claim 15, wherein the organic bond includes an epoxy resin.

23. The bonded-abrasive tool of claim 15, wherein the organic bond includes a phenolic resin.

24. The bonded-abrasive tool of claim 15, wherein the concentration of the hydrated filler is between about 20% and about 40%, by volume, of the organic bond and filler.

25. The bonded-abrasive tool of claim 15, the tool further comprising porosity, wherein the concentration of the organic bond is in a range between about 20% and about 60%, by volume, of the organic bond, the abrasive grains, filler in the bond, and porosity.

26. The bonded-abrasive tool of claim 25, wherein the concentration of the organic bond is in a range between about 30% and about 42%, by volume, of the organic bond, the abrasive grains, filler in the bond, and porosity.

27. The bonded-abrasive tool of claim 15, wherein the abrasive grains have a size between about 4 grit and about 240 grit.

28. The bonded-abrasive tool of claim 27, wherein the abrasive grains have a size between about 4 grit and about 80 grit.

29. The bonded-abrasive tool of claim 15, wherein the concentration of the abrasive grains is in a range between about 34% and about 56%, by volume, of the organic bond, the abrasive grains, filler in the bond, and any porosity.

30. The bonded-abrasive tool of claim 29, wherein the concentration of the abrasive grains is in a range between about 40% and about 52%, by volume, of the organic bond, the abrasive grains, filler in the bond, and any porosity.

31. A coated-abrasive tool, comprising:

a) a flexible substrate;

b) abrasive grains bonded to the flexible substrate; and c) an organic bond containing sodium antimonate, wherein the organic bond is coated on the flexible substrate.

32. A coated-abrasive tool, comprising:

a) a flexible substrate;

b) abrasive grains bonded to the flexible substrate; and c) an organic bond containing a hydrated filler, wherein the organic bond is coated on the flexible substrate, and wherein the hydrated filler is selected from the group consisting of magnesium hydroxide, hydrated sodium silicate, alkali metal hydrates, nesquehonite, and hydrated zinc borate, wherein the hydrated filler is present in an amount greater than about 50% by weight of the combined solids weight of the organic bond and filler.

33. The coated-abrasive tool of claim 32, wherein the hydrated filler is hydrated zinc borate.

34. The coated-abrasive tool of claim 32, wherein the hydrated filler is magnesium hydroxide.

35. The coated abrasive tool of claim 32, wherein the hydrated filler is present in an amount in a range of between about 60% and about 80% by weight of the combined solids weight of the organic bond and the filler.

* * * * *